US009900708B2

(12) United States Patent
Vinter

(10) Patent No.: US 9,900,708 B2
(45) Date of Patent: Feb. 20, 2018

(54) HEARING INSTRUMENT WITH SWITCHABLE POWER SUPPLY VOLTAGE

(71) Applicant: GN Hearing A/S, Ballerup (DK)

(72) Inventor: Martin Vinter, Copenhagen (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 14/145,450

(22) Filed: Dec. 31, 2013

(65) Prior Publication Data

US 2015/0189447 A1 Jul. 2, 2015

(30) Foreign Application Priority Data

Dec. 27, 2013 (DK) ..... 2013 70823
Dec. 27, 2013 (EP) ..... 13199691

(51) Int. Cl.
*H04R 25/00* (2006.01)
*H04R 1/10* (2006.01)

(52) U.S. Cl.
CPC ..... *H04R 25/30* (2013.01); *H04R 25/602* (2013.01); *H04R 1/1025* (2013.01); *H04R 2460/03* (2013.01)

(58) Field of Classification Search
CPC .... H04R 25/602; H04R 1/1025; H04R 25/30; H04R 2460/30
USPC ..... 381/323
See application file for complete search history.

(56) References Cited

U.S. PATENT DOCUMENTS 4,115,739 A 9/1978 Sano et al.
5,796,848 A 8/1998 Martin
5,973,552 A 10/1999 Allan
6,058,076 A * 5/2000 Komninos ..... 367/135
6,628,795 B1 * 9/2003 Ludvigsen ..... 381/321
8,072,266 B1 12/2011 Hoomes et al.
2003/0080816 A1 5/2003 Quarfoot et al.
(Continued)

FOREIGN PATENT DOCUMENTS

GB 2451536 A 2/2009

OTHER PUBLICATIONS

Second Technical Examination dated Aug. 27, 2014, for related Danish Patent Application No. PA 2013 70823, 3 pages.
(Continued)

*Primary Examiner* — Sean H Nguyen
(74) *Attorney, Agent, or Firm* — Vista IP Law Group, LLP

(57) ABSTRACT

A hearing instrument includes: a microphone comprising a microphone transducer element, wherein the microphone transducer element is configured to provide a transducer signal in response to receipt of sound; a microphone amplification circuit configured to generate an amplified microphone signal based on the transducer signal; a control and processing circuit for receipt and processing of the amplified microphone signal according to a hearing loss of a user; and a level detector configured to detect a level of the amplified microphone signal; wherein the microphone amplification circuit is coupled to a switchable power supply, and wherein the switchable power supply is configured to selectively connect a first power supply voltage, having a first DC voltage level, or a second power supply voltage, having a second DC voltage level higher than the first DC voltage level, to the microphone amplification circuit based on the detected level of the amplified microphone signal.

18 Claims, 3 Drawing Sheets

(56) References Cited

U.S. PATENT DOCUMENTS

| | | | | |
|---|---|---|---|---|
| 2004/0013263 | A1 | 1/2004 | Maclean et al. | |
| 2005/0012554 | A1 | 1/2005 | Somerville et al. | |
| 2005/0213787 | A1 | 9/2005 | Collins | |
| 2009/0152953 | A1* | 6/2009 | Dong | H01M 8/04544 307/80 |
| 2010/0259397 | A1* | 10/2010 | Du et al. | 340/618 |
| 2011/0068872 | A1 | 3/2011 | Iwamatsu | |
| 2011/0123048 | A1 | 5/2011 | Wang et al. | |
| 2012/0182081 | A1* | 7/2012 | Tsuchiya et al. | 333/14 |
| 2013/0108088 | A1 | 5/2013 | Jensen et al. | |
| 2015/0137886 | A1 | 5/2015 | Tanio | |

OTHER PUBLICATIONS

Third Technical Examination (Intention to Grant) dated Oct. 7, 2014, for related Danish Patent Application No. PA 2013 70823, 2 pages.

Examination Report and Search Report dated Feb. 25, 2014 in Application No. PA 2013 70823, (8 pages).

Extended European Search Report dated Jun. 2, 2014 in Application No. 13199691.0-1910, Applicant: GN Resound A/S (7 pages).

* cited by examiner

HEARING INSTRUMENT WITH SWITCHABLE POWER SUPPLY VOLTAGE

RELATED APPLICATION DATA

This application claims priority to and the benefit of Danish Patent Application No. PA 2013 70823, filed on Dec. 27, 2013, pending, and European Patent Application No. EP 13199691.0, filed on Dec. 27, 2013, pending. The entire disclosures of both of the above applications are expressly incorporated by reference herein.

FIELD

The present disclosure relates to hearing instruments.

BACKGROUND

Hearing instruments or hearing aids typically comprises a microphone amplification assembly which includes one or several microphones for receipt of incoming sound such as speech and music. The incoming sound is converted to an electric microphone signal or signals that are amplified and processed in a control and processing circuit of the hearing instrument in accordance with one or more preset listening program(s). These listening programs have typically been computed from a user's specific hearing deficit or loss for example expressed in an audiogram. An output amplifier of the hearing instrument delivers the processed microphone signal to the user's ear canal via a miniature speaker or receiver that may be housed in a casing of the hearing instrument together with the microphone or separately in an ear plug.

The noise-level of an input stage of a microphone amplification circuit is generally critical to an overall noise floor in the hearing aid for example expressed as equivalent input noise level in dB SPL at the microphone. The input stage may comprise a single MOSFET or bipolar transistor with a suitable bias current source that determines a bias current through the MOSFET or bipolar transistor. Since the noise level of the input stage is strongly dependent on the bias current level with increasing noise level at decreasing bias current level, this limits how small the bias current can be without the noise level becomes unacceptably high. At the same time, the input stage must also be able to handle the maximum audio signal level the microphone can output without noticeable distortion which requires the input stage is supplied with a relatively high power supply voltage to accommodate the ac signal swing at the maximum audio signal level. Where the microphone comprises an internal preamplifier, i.e. mounted inside the microphone housing, powered by a certain DC supply voltage delivered by the microphone amplification assembly, it has become normal practice to use a higher DC supply voltage for the input stage of the microphone amplification circuit. This higher DC supply voltage may be about 2 times higher than the supply voltage of the build-in microphone preamplifier. At the same time a relatively large bias current is still required in the input stage of the microphone amplification circuit for the reasons discussed above. This means that the input stage may consume as much as 25% of a total current consumption of the microphone amplification circuit even including analog-to-digital conversion of the amplified microphone signal.

In view of the limited amount of energy stored in typical hearing instrument battery cells, it may be desirable to reduce the power consumption of hearing instrument circuitry and components where and whenever possible. Hence, reducing the power consumption of the input stage of the microphone amplification circuit without compromising noise performance and the ability to handle the maximum audio signal level may be desirable and advantageous.

SUMMARY

In one embodiment, a hearing instrument comprises a microphone comprising a microphone transducer element mounted in a microphone housing. The microphone transducer element produces a transducer signal in response to receipt of sound and a microphone amplification circuit is configured to generate an amplified microphone signal from the transducer signal. A control and processing circuit of the hearing instrument is coupled to the microphone amplification circuit for receipt and processing of the amplified microphone signal according to a hearing loss of a user. The microphone amplification circuit has a power supply port coupled to a switchable power supply which is selectively connected to a first power supply voltage, having a first DC voltage level, or a second power supply voltage, having a second DC voltage level, to the power supply port of the microphone amplification circuit. The second DC voltage level is higher than the first DC voltage level. A level detector is configured to detect a level of a microphone signal and connect the first or the second power supply voltage to the power supply port based on the detected level of the microphone signal.

A first aspect relates to a hearing instrument which comprises a microphone comprising a microphone transducer element mounted in a microphone housing. The microphone transducer element produces a transducer signal in response to receipt of sound and a microphone amplification circuit is configured to generate an amplified microphone signal from the transducer signal. A control and processing circuit of the hearing instrument is coupled to the microphone amplification circuit for receipt and processing of the amplified microphone signal according to a hearing loss of a user. The microphone amplification circuit has a power supply port coupled to a switchable power supply which is selectively connected to a first power supply voltage, having a first DC voltage level, or a second power supply voltage, having a second DC voltage level, to the power supply port of the microphone amplification circuit. The second DC voltage level is higher than the first DC voltage level. A level detector is configured to detect a level of a microphone signal and connect the first or the second power supply voltage to the power supply port based on the detected level of the microphone signal.

The skilled person will understand that the level of the microphone signal may be detected from various kinds of microphone signals present in the microphone amplification circuit such as the amplified microphone signal at the output of the microphone amplification circuit or a microphone input signal to the microphone amplification circuit or even a microphone signal tapped directly from the microphone transducer element. The level detector may be configured to detect the level of the microphone signal in an indirect manner from another signal proportional to the level of the microphone signal. The level detector may for example form part of an automatic gain control circuit (AGC) of the microphone amplification circuit. In the latter case, the AGC circuit may derive a gain control signal for a variable gain microphone preamplifier based on the level of the microphone signal. Consequently, the level of the microphone signal may be computed from the gain control signal of the AGC circuit since the latter based on a known relationship between the level of the microphone signal and the gain control signal.

The control and processing circuit of the hearing instrument may comprise a software programmable microprocessor core and/or a DSP core processing a digitized version of the microphone signal. The control and processing circuit may in the alternative comprise a hard-wired DSP implemented by an appropriately configured assembly of digital sequential and combinatorial logic circuitry. The digitized version of the microphone signal may in both instances be generated by an analog-to-digital converter as discussed below.

The switching of DC voltage level between the first and second DC voltage levels is advantageous because this feature allows the lower, first, DC voltage level to power the microphone amplification circuit at relatively low and normal levels of the microphone signal. These relatively low and normal levels of the microphone signal may for example correspond to a sound pressure level on the microphone transducer element up till 90 dB SPL, or 100 dB SPL. For higher sound pressure levels, the level detector may connect the second DC voltage level to the power supply port of the microphone amplification circuit. Consequently, since the sound pressure level in many typical sound environments lies below 90 dB SPL, or 100 dB SPL, the total operational time where the first power supply voltage is coupled to the microphone amplification circuit may be much longer than the total operational time where the microphone amplification circuit is coupled to the second power supply voltage. Hence, the microphone amplification circuit is on one hand capable of operating with a low power consumption for the majority of time without compromising noise performance, where the sound pressure level is low or normal, and on the other hand still capable of handling much larger sound pressure levels without noticeable distortion by switching to the second power supply voltage where the higher DC voltage level allows larger ac signal swing in the microphone amplification circuit. The skilled person will appreciate that the level detector may comprise a predetermined threshold level and be configured to compare the detected level of the microphone signal with this threshold level. The level detector may subsequently connect the first power supply voltage to the power supply port of the microphone amplification circuit if the detected microphone signal level is below the predetermined threshold level and connect the second power supply voltage to the power supply port if the detected microphone signal level is above the predetermined threshold level. The predetermined threshold level of the microphone signal may for example correspond to the above-discussed 90 dB SPL, or 100 dB SPL sound pressure levels on the microphone transducer element.

The microphone amplification circuit may comprise a single stage preamplifier or multiple series coupled preamplifiers. In both embodiments, the microphone amplification circuit and the microphone transducer element may be arranged inside the microphone housing.

The microphone amplification circuit may be fully contained in the microphone housing, distributed between the microphone housing and the control and processing circuit or fully contained in the control and processing circuit. The control and processing circuit may in the two latter embodiments comprise a mixed-signal ASIC. In the first case, the control and processing circuit may be a digital logic only type of ASIC. A multi-stage embodiment of the microphone amplification circuit comprises first and second preamplifiers coupled in cascade or series. The first preamplifier is coupled directly to the transducer signal of the microphone transducer element and supplied with power from the first power supply voltage, or a third power supply voltage with a third DC voltage level lower than the second DC voltage level. Furthermore, the second preamplifier comprises a signal input port coupled to a signal output port of the first preamplifier and a power supply port coupled to the switchable power supply. In this embodiment, the first preamplifier may be a unity-gain buffer for example a single MOSFET or JFET source follower with limited demands on its signal handling capability because of the unity voltage gain. Hence, the first preamplifier is coupled to the first and lower power supply voltage or a similarly low DC supply voltage level. The DC level of the first, lower, power supply voltage may be about 1.0 V and the supply voltage for example derived from a battery voltage of the hearing instrument via a linear voltage regulator or simple RC lowpass filter.

The second preamplifier may have significant voltage amplification such as between 3 dB and 20 dB and therefore need larger signal handling capability than the first preamplifier. Hence, the power supply port of the second preamplifier is coupled to the switchable power supply such that the second power supply voltage can be selected by the level detector when needed to avoid distortion for example when the amplified microphone signal is above the previously discussed predetermined threshold level.

According to a multi-stage and distributed embodiment of the microphone amplification circuit, the microphone transducer element and the first preamplifier are arranged in a common microphone housing of the microphone. The microphone housing comprises a power supply terminal coupled to the first or third power supply voltage. In addition, the second preamplifier, the controllable switch arrangement, the first and second power supplies and the level detector are integrated on the control and processing circuit of the hearing instrument.

The switchable power supply preferably comprises a controllable switch arrangement responsive to a switch control signal generated by the level detector. The controllable switch arrangement may be coupled connected to the first power supply voltage and to the second power supply voltage via first and second switch inputs, respectively. Furthermore, a switch output of the controllable switch arrangement is connected to the power supply port of the microphone amplification circuit. The controllable switch arrangement may comprise one or more semiconductor switches with respective control terminals connected to the switch control signal as described in further detail below.

In one advantageous embodiment, the level of the microphone signal is detected in a digital domain. This embodiment of the hearing instrument comprises an analog-to-digital converter configured for generating a digitized microphone signal based on the microphone signal such as the amplified microphone signal and the level detector comprises a digital level detector configured for computing a level of the digitized amplified microphone signal. The digital level detector is configured for supplying a digital control signal to the controllable switch arrangement. One embodiment of the digital level detector may comprise appropriately configured digital logic circuitry to implement the functionality of the digital level detector in hardware. An alternative embodiment of the digital level detector may comprise a program routine or software component to implement the functionality of the digital level detector in software. This software component may comprise a predetermined set of executable program instructions of a software programmable DSP core of the previously described control and processing circuit of the hearing instrument. The skilled person will understand that the digital level detector in yet another alternative may be implemented as a combination of software component(s) and digital hardware.

A second aspect relates to a microphone assembly for a hearing instrument. The microphone assembly comprises a microphone comprising a microphone transducer element mounted in a microphone housing. The microphone transducer element produces a transducer signal in response to receipt of sound. A microphone amplification circuit is configured to generate an amplified microphone signal from the transducer signal. The microphone amplification circuit has a signal input port coupled to the transducer signal and a power supply port coupled to a switchable power supply. The switchable power supply is configured to selectively connect a first power supply voltage, having a first DC voltage level, or a second power supply voltage, having a second DC voltage level, to the power supply input of the microphone amplification circuit; where the second DC voltage level is higher than the first DC voltage level. A level detector is configured to detect a level of the microphone signal and connect the first or the second power supply voltage to the power supply port of the microphone amplification circuit based on the detected level of the microphone signal.

The switchable power supply may comprise a controllable switch arrangement responsive to a switch control signal generated by the level detector as discussed above in connection with the first aspect. The controllable switch arrangement is connected to the first power supply voltage and to the second power supply voltage via first and second switch inputs, respectively, and a switch output is connected to the power supply port of the microphone amplification circuit.

The microphone amplification circuit may be configured as disclosed above in connection with the first aspect. Hence, in one embodiment the microphone amplification circuit comprises a first preamplifier coupled directly to the transducer signal of the microphone transducer element and supplied with power from the first power supply voltage or a third power supply voltage with a third DC voltage level lower than the second DC voltage level. Furthermore, a second preamplifier of the microphone amplification circuit comprises a signal input port coupled to a signal output port of the first preamplifier and a power supply port coupled to the switchable power supply.

One embodiment of the second preamplifier comprises a bias current source coupled between an input transistor of the microphone amplification circuit and the output of the controllable switch arrangement. In this manner, the bias current source is connected at the output side of the controllable switch arrangement and the same bias current source may conveniently be used to bias the input transistor independent of a state of the switch arrangement. The noise performance of the microphone amplification circuit will often be dominated by the noise level of the input transistor of the second preamplifier; hence it may be advantageous to maintain the latter noise level substantially constant independent of whether the second preamplifier is connected to the first or the second power supply voltage via the switch arrangement. In this case, the bias current source may be configured to provide a substantially constant bias current independent of the level of the microphone signal. The bias current source may be configured to set a DC bias current between 2 μA and 25 μA in the input transistor. In this context, a substantially constant bias current means that the DC bias current varies with less than 10% from a zero level of the microphone signal to a microphone signal level which corresponds to a sound pressure level of 100 dB on the microphone transducer element microphone at 1 kHz.

In an alternative embodiment, two separate bias current sources are connected at the input side of the controllable switch arrangement and different DC bias currents to the input transistor may conveniently be set depending on the state of the controllable switch arrangement. According to this embodiment, a first bias current source is coupled between the first power supply voltage and the first input of the controllable switch arrangement and a second bias current source is coupled between the second power supply voltage and the second input of the controllable switch arrangement. However, the two separate bias current sources may of course be configured to provide substantially identical DC bias currents, e.g. bias current values as mentioned above such that a substantially constant bias current is provided to the second preamplifier independent of the state of the controllable switch arrangement. Hence, if the bias current of the first preamplifier is also substantially constant, the entire microphone amplification circuit may have a substantially constant bias current. Each of the first and second bias current sources may comprise a transistor such as a PMOS transistor as discussed in further detail below with reference to the appended drawings.

To minimize the generation of audible artefacts, such as pops and clicks, in connection with switching forth and back between the first and second power supply voltages, a time constant circuit may be coupled to the level detector or integrated in the level detector to set an appropriate attack time and an appropriate release time. The attack time is preferably set to a small value such that switching frequency components are situated above the audible frequency range, i.e. above 20 kHz. The attack time may be less than 50 μs and more preferably less than 10 μs. During the attack time, the switch control signal may be utilized to disconnect the power supply port of the microphone amplification circuit from the first power supply voltage and connect the microphone amplification circuit to the second power supply voltage via the controllable switch arrangement. The opposite connect/disconnect operation is performed during the release time. The release time is preferably set to a significantly larger value than the attack time such that switching frequency components largely falls below the audible frequency range, i.e. below 20 Hz. Hence, the release time of the time constant circuit may be set to a value larger than 50 ms.

As briefly mentioned above, controllable switch arrangement may comprise one or more semiconductor switches with respective control terminals connected to the switch control signal. According to one such embodiment, the controllable switch arrangement comprises a first semiconductor switch connected between the first switch input and the switch output; and a second semiconductor switch connected between the second switch input and the switch output. Furthermore, each of the first and second semiconductor switches has a control terminal coupled to the switch control signal. Each of the first and second semiconductor switches preferably comprises a semiconductor switch such as a MOSFET which exhibits a low on-state resistance, a high off-state resistance and high impedance at the control terminal, i.e. gate.

In one advantageous embodiment, each of the first and second bias current sources also functions as switch of the switch arrangement thereby integrating the previously described functionality of the switch arrangement with the bias current supply to the microphone amplification circuit. In one such embodiment, the first bias current source is integrated with the first semiconductor switch of the controllable switch arrangement and the second bias current source is integrated with the second semiconductor switch of the controllable switch arrangement. Each of the first and second bias current sources/switches may comprise a PMOS or NMOS transistor as disclosed in further detail below with reference to the appended drawings. This embodiment may reduce the number of components of the microphone assembly compared to embodiments that uses separate bias current sources and switches. The first and second power supply voltages may be generated by various kinds of voltage supplies. As mentioned above, the first and/or the third power supply voltage may be generated by a linear voltage regulator or a simple RC lowpass filter fed from a battery supply voltage of the hearing instrument. The battery supply voltage may be generated by a battery source of the hearing instrument such as a traditional 1.2 V Zinc-Air battery cell or by one or more rechargeable battery cells. The microphone assembly may comprise a DC-DC power converter, such as a boost converter or charge pump, configured to generate the second power supply voltage. The DC-DC power converter may be fed from the batter supply voltage or from the first power supply voltage. The second DC voltage level may be at least 1.5 times higher than the first DC voltage level such as between 1.5 and 3.0 times higher than the first DC voltage level by proper adaptation of the DC-DC power converter.

The microphone amplification circuit, the controllable switch arrangement, the voltage supplies and the control and processing circuit may be integrated on a sub-micron digital CMOS based semiconductor die or substrate.

A hearing instrument includes: a microphone comprising a microphone transducer element mounted in a microphone housing, wherein the microphone transducer element is configured to provide a transducer signal in response to receipt of sound; a microphone amplification circuit configured to generate an amplified microphone signal based on the transducer signal; a control and processing circuit coupled to the microphone amplification circuit for receipt and processing of the amplified microphone signal according to a hearing loss of a user; and a level detector configured to detect a level of the amplified microphone signal; wherein the microphone amplification circuit is coupled to a switchable power supply, and wherein the switchable power supply is configured to selectively connect a first power supply voltage, having a first DC voltage level, or a second power supply voltage, having a second DC voltage level, to the microphone amplification circuit based on the detected level of the amplified microphone signal, the second DC voltage level being higher than the first DC voltage level.

Optionally, the microphone amplification circuit comprises: a first preamplifier coupled to the microphone transducer element and is configured to receive power from the first power supply voltage, or a third power supply voltage with a third DC voltage level lower than the second DC voltage level; and a second preamplifier comprising a signal input port coupled to a signal output port of the first preamplifier, and a power supply port coupled to the switchable power supply.

Optionally, the microphone transducer element and the first preamplifier are arranged in the microphone housing of the microphone; the microphone housing comprising a power supply terminal coupled to the first or third power supply voltage; and wherein the second preamplifier, the first and second power supplies, and the level detector being integrated on the control and processing circuit of the hearing instrument.

Optionally, the switchable power supply is configured for connecting the first power supply voltage to the microphone amplification circuit if the detected level is below a predetermined threshold level, and for connecting the second power supply voltage to the microphone amplification circuit if the detected level is equal to or above the predetermined threshold level.

Optionally, the switchable power supply comprises a controllable switch arrangement responsive to a switch control signal generated by the level detector; wherein the controllable switch arrangement is coupled to the first power supply voltage and to the second power supply voltage via first and second switch inputs, respectively; and wherein the switchable power supply is configured by the switch control signal to selectively connect the first power supply voltage or the second power supply voltage to the microphone amplification circuit.

Optionally, the microphone amplification circuit further comprises an analog-to-digital converter configured for generating a digitized microphone signal based on the amplified microphone signal; and wherein the level detector comprises a digital level detector configured for computing a level of the digitized microphone signal and supplying the switch control signal to the controllable switch arrangement, the switch control signal being a digital switch control signal.

A microphone assembly for a hearing instrument includes: a microphone comprising a microphone transducer element mounted in a microphone housing, wherein the microphone transducer element is configured to provide a transducer signal in response to receipt of sound; a microphone amplification circuit configured to generate an amplified microphone signal based on the transducer signal; and a level detector configured to detect a level of the microphone signal; wherein the microphone amplification circuit is coupled to a switchable power supply; wherein the switchable power supply is configured to selectively connect a first power supply voltage, having a first DC voltage level, or a second power supply voltage, having a second DC voltage level, to the microphone amplification circuit based on the detected level of the microphone signal, the second DC voltage level being higher than the first DC voltage level.

Optionally, the switchable power supply comprises a controllable switch arrangement responsive to a switch control signal generated by the level detector; wherein the controllable switch arrangement is connected to the first power supply voltage and to the second power supply voltage via first and second switch inputs, respectively; and wherein the switchable power supply is configured by the switch control signal to selectively connect the first power supply voltage or the second power supply voltage to the microphone amplification circuit.

Optionally, the microphone amplification circuit comprises: a first preamplifier coupled to the microphone transducer element, and is configured to receive power from the first power supply voltage, or a third power supply voltage with a third DC voltage level lower than the second DC voltage level; and a second preamplifier comprising a signal input port coupled to a signal output port of the first preamplifier, and a power supply port coupled to the switchable power supply.

Optionally, the microphone assembly further includes a bias current source coupled between an input transistor of the microphone amplification circuit and an output of the controllable switch arrangement.

Optionally, the bias current source is configured to provide a substantially constant bias current independent of the level of the microphone signal.

Optionally, the microphone assembly further includes: a first bias current source coupled between the first power supply voltage and the first switch input of the controllable switch arrangement; and a second bias current source coupled between the second power supply voltage and the second switch input of the controllable switch arrangement.

Optionally, the microphone assembly further includes a time constant circuit coupled to the level detector and configured to set an attack time and a release time of the switch control signal; wherein the switch control signal during the attack time disconnects the microphone amplification circuit from the first power supply voltage and connects the microphone amplification circuit to the second power supply voltage via the controllable switch arrangement.

Optionally, the controllable switch arrangement comprises: a first semiconductor switch connected between the first switch input and a switch output; and a second semiconductor switch connected between the second switch input and the switch output; each of the first and second semiconductor switches having a control terminal coupled to the level detector.

Optionally, a first bias current source is integrated with the first semiconductor switch of the controllable switch arrangement, and a second bias current source is integrated with the second semiconductor switch of the controllable switch arrangement.

Other and further aspects and features will be evident from reading the following detailed description.

BRIEF DESCRIPTION OF THE DRAWINGS

Embodiments will be described in more detail in connection with the appended drawings in which.

DETAILED DESCRIPTION

Various embodiments are described hereinafter with reference to the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Figure 1:
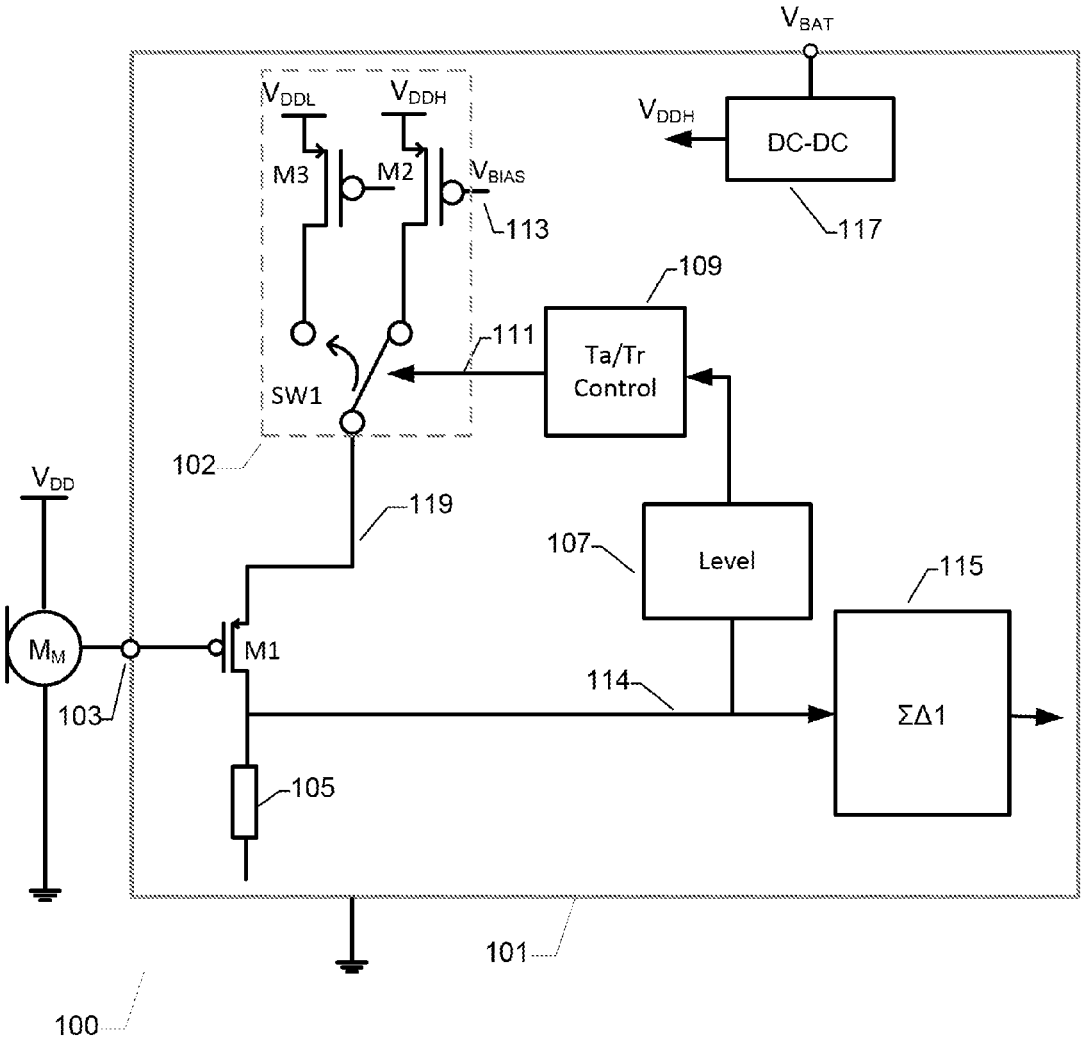
FIG. 1 is a simplified schematic block diagram of a microphone assembly for a hearing instrument comprising a switchable power supply in accordance with an embodiment.

FIG. 1 is a simplified schematic block diagram of a microphone assembly 100 comprising a switchable power supply of a hearing instrument. The hearing instrument may comprise any type of hearing aid housing style such as Behind-the-Ear (BTE), In-the-Canal (ITC), Completely-in-Canal (CIC) etc. The hearing instrument may comprise certain customary components such as an output amplifier, a control and processing circuit and a miniature receiver/speaker for production of ear canal sound pressure which all have been omitted for simplicity. The control and processing circuit may be coupled to a digitized microphone signal supplied at an output of the microphone assembly 100 via an output of analog-to-digital converter ΣΔ1 115. The control and processing circuit may comprise a software programmable DSP core that applies one or more signal processing functions to the digitized microphone signal from $M_M$ according to the hearing loss of the user of the hearing instrument. These signal processing functions may comprise different processing parameters of functions like non-linear amplification, noise reduction, frequency response shaping etc.

The microphone assembly 100 comprises a microphone $M_M$ powered by through an externally accessible positive power supply terminal $V_{DD}$. The microphone assembly $M_M$ comprises a microphone transducer element (not shown) mounted in a microphone housing (not shown). The microphone transducer element may comprise a capacitive electret transducer element which generates a transducer signal in response to receipt of sound. The microphone $M_M$ furthermore comprises a first preamplifier (not shown) coupled directly to the output of the microphone transducer element. This preamplifier may possess an extremely high input impedance to allow coupling to the capacitive electret transducer element with minimum signal loss. This first preamplifier is supplied with power from the positive power supply terminal $V_{DD}$. An amplified or buffered version of the microphone signal is supplied by the first preamplifier on a microphone signal output terminal 103 to a second preamplifier that is integrated on a separate microphone amplification circuit 101 of the microphone assembly 100. The second preamplifier comprises an input stage comprising PMOS transistor M1 with its gate input coupled to the amplified or buffered version of the microphone signal. The PMOS transistor M1 may in conjunction with drain or load circuit 105, e.g. comprising one or more load resistors, be configured to provide a predetermined small signal amplification of the buffered or amplified microphone signal delivered by the microphone $M_M$ before conversion into digital format by the ΣΔ1 analog-to-digital converter 115. The skilled person will understand that the second preamplifier may comprise only a single amplification stage as illustrated by PMOS transistor M1 or several amplification stages e.g. stages coupled in cascade. Furthermore, M1 may comprise different types of transistor devices than the illustrated by PMOS transistor for example a NMOS transistor, a JFET or bipolar (BJT) transistor.

The microphone amplification circuit additionally 101 comprises a switchable power supply 102 comprising a switch arrangement SW1, PMOS transistors M2 and M3 and two separate power supply voltages $V_{DDL}$ and $V_{DDH}$. The first power supply voltage $V_{DDL}$ provides a first DC voltage level and the second power supply voltage $V_{DDH}$ has a second DC voltage level which is higher in absolute terms (i.e. a larger positive DC voltage or a larger negative DC voltage) than the first DC voltage level. The first power supply voltage $V_{DDL}$ may be applied to the positive power supply terminal $V_{DD}$ of the microphone $M_M$. The absolute values of the first and second DC voltage levels and their difference may vary according to characteristics of the hearing instrument in question. If the power source of the hearing instrument is a typical hearing aid battery cell such as a 1.2 V Zinc-Air battery, the first DC voltage level may be adjusted by a voltage regulator, such as a linear regulator or simple RC based lowpass filter, to about 0.9-1.1 V. In that situation, the second DC voltage level may be set to about the double value of the first DC voltage level, i.e. about 1.8-2.2 V. The skilled person will appreciate that the second power supply voltage $V_{DDH}$ may be generated by a suitably configured DC-DC power converter 117 such as a boost converter or charge pump coupled directly to the battery voltage terminal VBAT of the microphone amplification circuit 101 or coupled to the regulated voltage discussed above. The DC-DC converter 117 may be followed by a linear type of voltage regulator to suppress supply noise or ripple on the second power supply voltage $V_{DDH}$ before the latter is coupled to the source terminal of M3.

The PMOS transistor M3 of the switchable power supply 102 is configured as a first substantially constant bias current source for the input stage around PMOS transistor M1 and supplies a desired preset DC bias current to M1 from the first, lower, power supply voltage $V_{DDH}$ when SW1 connects the bias current source to the power supply port or input 119 of M1. The selected level of DC bias current will vary depending on noise requirements of the input stage transistor M1, since larger bias current leads to lower noise at the expense of increasing power consumption. However, M3 may be configured to deliver a first DC bias current to M1 between 2 μA and 25 μA for typical hearing aid applications. The desired first DC bias current may be set by an appropriately configured current mirror circuit (now shown) coupled to the gate terminal 113 of M3 and supplying an appropriate DC bias voltage $V_{BIAS}$. The PMOS transistor M2 of the switchable power supply 102 is configured as a second constant bias current source for the input stage around PMOS transistor M1 and supplies the desired second DC bias current to M1 from the second (and higher) power supply voltage $V_{DDH}$ when SW1 connects this bias current source to the power supply port 119 of M1. M2 may be configured to deliver a second DC bias current level between 2 μA and 25 μA for typical hearing aid applications for the reasons discussed above in the same connection. Hence, the switch arrangement SW1 is configured to selectively connect either the first bias current source M3 or the second bias current source M2 to the power supply port 119 of M1 to supply operating current to the input stage while the disconnected bias current source may be cut-off and essentially left without any current.

The skilled person will appreciate that the first DC bias current and second DC bias current may be set to essentially identical levels. This will keep the noise level of the input stage of the microphone amplification circuit largely constant independent of the active/selected bias current source because the bias current level is the dominant factor for the noise level provided that transistor dimensions of M1 are sufficiently large to reduce flicker-noise to an insignificant level. However, in an alternative embodiment, the first DC bias current level may be set to a markedly larger level, for example 2 times larger, than the second DC bias current level by suitable configuration of M2 and M3.

The microphone amplification circuit 101 further comprises a level detector 107 that is configured to detect a level of the amplified microphone signal 114 at an output node of the second preamplifier. This output node may be the output of the input stage configured around PMOS transistor M1 as schematically indicated on FIG. 1. The skilled person will appreciate that other microphone signals present in the microphone amplification circuit may be used instead for the purpose of detecting the level. The level detector 107 may be configured to make various kinds of level estimates of the amplified microphone signal such as a peak voltage or peak power, RMS voltage or power level, average voltage or power level etc. The level detector 107 may be configured to compare the detected level of the amplified microphone signal 114 with a threshold voltage or reference voltage and selectively connect the first or the second power supply voltage $V_{DDL}$, $V_{DDH}$ to the power supply input 119 of the second preamplifier based on whether the detected level is above or below the threshold voltage. The level detector 107 generates an appropriate switch control signal 111, through an optional release and attack time circuit 109, and applies this control signal to one or more control inputs of the switch arrangement SW1 such that the desired power supply voltage is selected and routed through SW1 while the other supply voltage is disconnected.

The threshold voltage or reference voltage of the level detector 107 may be set at a value that corresponds to a particular level of the amplified microphone voltage where it is desired to switch from the first power supply voltage $V_{DDL}$ to the second, and higher, power supply voltage $V_{DDH}$ via the switch arrangement SW1. The switch of supply voltage may for example be desired because the input stage of the second preamplifier around M1 is unable to handle the voltage signal swing of the amplified microphone signal 114 generated by the microphone $M_M$ without audible distortion. This situation is of particular relevance when the power supply voltage $V_{DD}$ of the first preamplifier, arranged in the microphone housing in the present embodiment, is approximately equal to the first power supply voltage $V_{DDL}$ and the second preamplifier has a minimum voltage headroom between the input signal and the $V_{DD}$ supply voltage in order to allow the current-source M3 and the input transistor M1 to operate correctly. The signal handling capability of the second preamplifier is markedly improve by coupling its power supply port 119 to the higher power supply voltage $V_{DDH}$ because of the accompanying increase of undistorted ac signal voltage swing at the drain of the input stage transistor M1. On the other hand, the DC bias current drawn by M1 is now supplied by the second and higher power supply voltage $V_{DDH}$ which means that the power consumption of the second preamplifier is markedly increased if the DC bias current of M1 is held approximately constant. Assuming that the first power supply voltage $V_{DDL}$ has a DC level of 1.0 V and the second power supply voltage $V_{DDH}$ has a DC level of 2.0 V the power consumption is approximately doubled by the switch of power supply voltage depending on practical conversion losses in the first and second power supplies. However, if the threshold voltage of the level detector is adjusted such that the reference sound pressure at the microphone $M_M$ has been selected to an appropriately high level, for example corresponding to a sound pressure level on the microphone transducer element above 90 dB SPL, or above 100 dB SPL, the total time where the second preamplifier is coupled to the second power supply voltage $V_{DDH}$ may be short compared to the total time where the second preamplifier is coupled to the first power supply voltage $V_{DDL}$ in many practical sound environments. Hence, the increased power consumption will only lead to a marginal higher average power consumption of the microphone assembly over time.

Consequently, the switchable power supply 102 in conjunction with the first and second power supply voltages $V_{DDL}$ and $V_{DDH}$ enable the second preamplifier to handling the maximum ac signal swing of the microphone signal at high sound pressure levels distortion free and without the marked increase of average power consumption of the prior art preamplifiers caused by the constant high supply voltage operation. In the present microphone amplification circuit, the average power consumption of the second preamplifier remains lower, because the power supply of the preamplifier is coupled to the first, and lower, power supply voltage $V_{DDL}$ when the microphone sound pressure level is at a low or normal level. This is by far are the most common sound environments in daily use of a hearing instrument. It is also noteworthy that the DC bias current in the second preamplifier may be held essentially unchanged when switched from the second power supply voltage to the first power supply voltage $V_{DDL}$ such that the noise level of the second preamplifier may be largely unaffected by the switch to $V_{DDL}$.

As discussed above, the level detector 107 generates an appropriate switch control signal 111, through the optional release and attack time circuit 109. The skilled person will appreciate that the release and attack time circuit 109 may be integrated with the level detector 107. The role of the release and attack time circuit 109 is to set an appropriate attack time and an appropriate release time of the switch control signal 111 to minimize any audible artefacts, such as pops and clicks, in connection with switching between the first and second power supply voltages $V_{DDL}$ and $V_{DDH}$. The attack time is preferably set to a small value such that switching frequency components are situated above the audible frequency range, i.e. above 20 kHz. The attack time may be less than 50 μs. During the attack time, the switch control signal disconnects the power supply port 119 of the second preamplifier from the first power supply voltage $V_{DDL}$ and connects the same to the second power supply voltage $V_{DDH}$ via the controllable switch arrangement SW1. The release time is preferably set to a significantly larger value than the attack time such that switching frequency components largely falls below the audible frequency range, i.e. below 20 Hz. This also ensures that the control signal will not change rapidly forth and back in response to pulsating sound patterns, but for example maintain the connection to the second power supply voltage $V_{DDH}$ until the sound pressure has fallen below the previously discussed sound pressure threshold for a reasonable time period. The release time may be set to a value larger than 50 ms. During the release time, the switch control signal 111 disconnects the power supply port 119 of the input stage of the second preamplifier from the second power supply voltage $V_{DDH}$ and connects the same to the first power supply voltage $V_{DDL}$ via the controllable switch arrangement SW1.

The controllable switch arrangement SW1 may be configured in various ways. In one embodiment, SW1 comprises a pair of independently operating semiconductor switches each being controlled by a separate switch control signal. Hence, the switch control signal may be a binary signal in this embodiment. A first semiconductor switch of this pair is connected between a first switch input and a switch output where latter is connected to the power supply port 119 of the second preamplifier. The switch input is connected to one of the first and second power supply voltages $V_{DDL}$ and $V_{DDH}$, respectively. A second semiconductor switch is connected between the second switch input and the switch output of the switch arrangement The input of second semiconductor switch is connected to the opposite power supply voltage of the first semiconductor switch. Each of the first and second semiconductor switches may comprise a MOSFET which exhibits a low on-state resistance, a high off-state resistance and high impedance at the control terminal, i.e. gate.

The ΣΔ1 analog-to-digital converter 115 that converts or digitizes the amplified microphone signal 114 may operate at an oversampled rate for example between 1 and 10 MHz In another embodiment, as discussed below in connection with FIG. 2, another type of analog-to-digital converter is utilized to minimize time delays in the power supply switching process caused by the digitization of the amplified microphone signal. The lower time delay may be beneficial when the level detector operates in the digital domain based on the digitized/sampled microphone signal instead of the analog domain utilized in the present embodiment as discussed in detail below.

Figure 2:
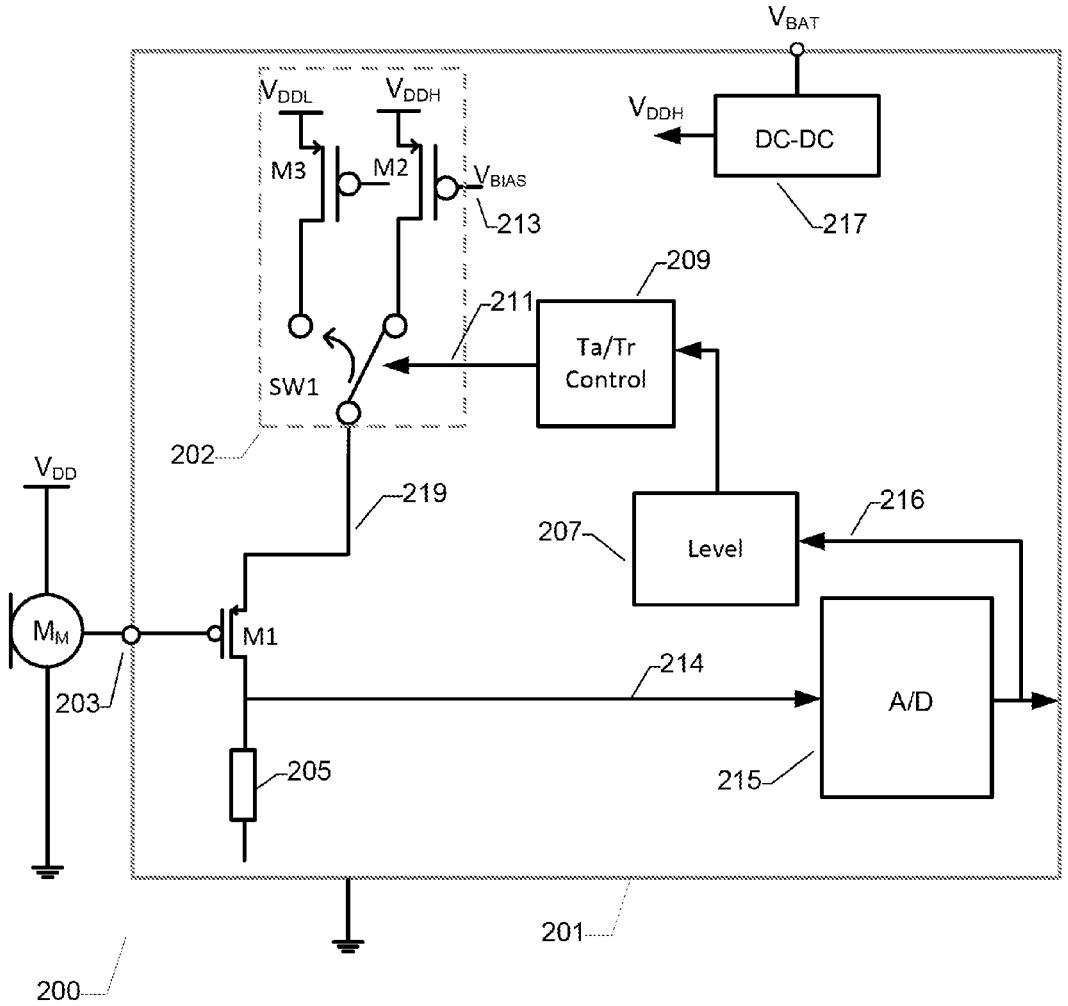
FIG. 2 is a simplified schematic block diagram of a microphone assembly for a hearing instrument comprising a switchable power supply in accordance with a second embodiment.

FIG. 2 is a simplified schematic block diagram of a microphone assembly 200 for a hearing instrument comprising a switchable power supply 202 in accordance with a second embodiment. The same features of the present embodiment and the previously discussed first embodiment have been supplied with corresponding reference numerals to ease comparison. The skilled person will understand that the general remarks above regarding the properties of the microphone $M_M$ and properties of the various passive and active devices and circuit blocks are equally applicable to the corresponding devices of the present embodiment unless otherwise stated. The main difference between the present microphone assembly 200 and the previously described embodiment of the microphone assembly 100 is that the level detector 207 operates in the digital domain detecting and responding to a digitized amplified microphone signal 216 supplied at the output of an analog-to-digital converter 215. The digitized amplified microphone signal 216 is derived by sampling and conversion of the amplified microphone signal 214 at the output of the second preamplifier. Hence, the level detector 207 may comprise appropriately configured digital logic circuitry operating on the digitized microphone signal 216. As mentioned above, the analog-to-digital converter 215 is preferably a type with low latency, such as a flash converter, to minimize the time delay from the amplified microphone signal 214 at the input of the analog-to-digital converter 215 to the switch control signal 211. The skilled person will understand that the level detector 207 and/or an optional release and attack time circuit 209 may be implemented as respective program routines/software components comprising a predetermined set of executable program instructions of a software programmable DSP core of the previously described control and processing circuit of the hearing instrument. The latter embodiment provides considerable flexibility in the design and adaptation of the respective functions of the level detector 207 and the release and attack time circuit 209.

Figure 3:
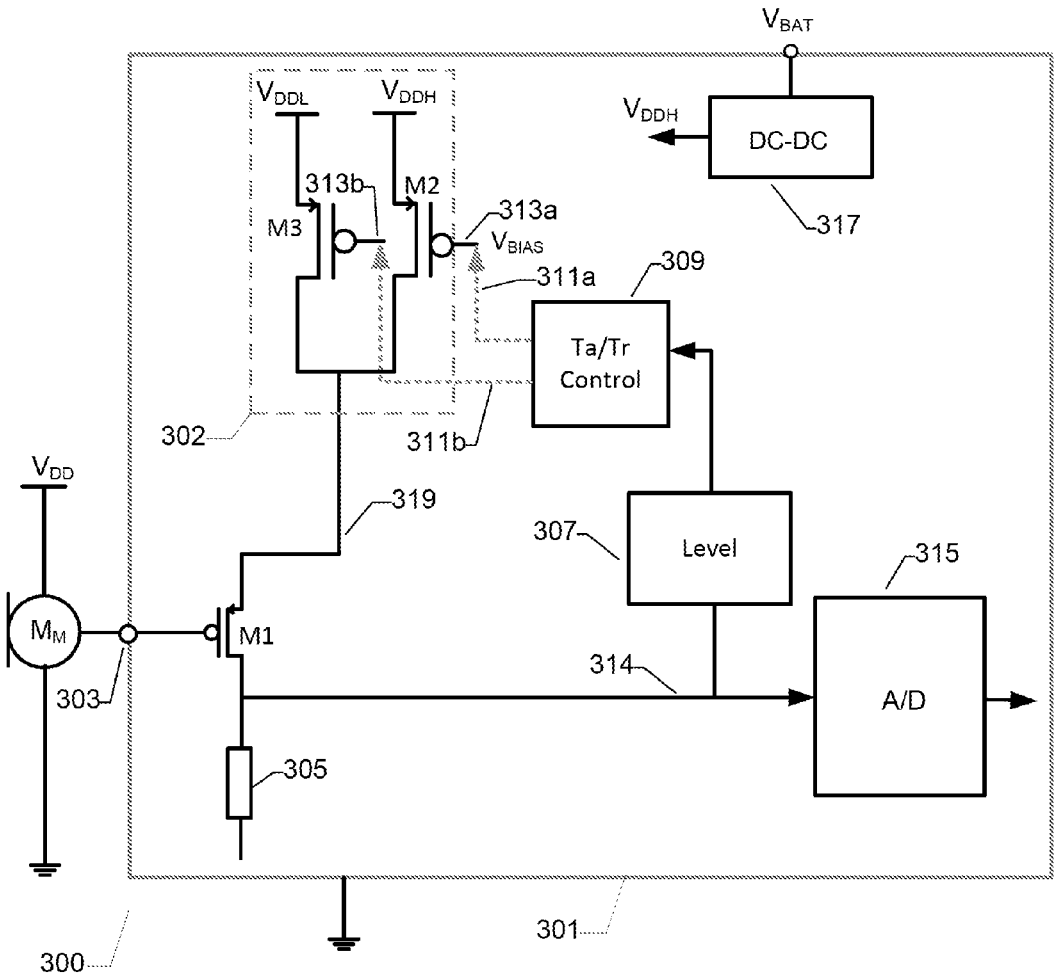
FIG. 3 is a simplified schematic block diagram of a microphone assembly for a hearing instrument comprising a switchable power supply in accordance with a third embodiment.

FIG. 3 is a simplified schematic block diagram of a microphone assembly 300 for a hearing instrument comprising a switchable power supply 302 in accordance with a third embodiment. The same features of the present embodiment and the previously discussed first embodiment have been supplied with corresponding reference numerals to ease comparison. The skilled person will understand that the general remarks above to the properties of the microphone $M_M$ and properties of the various passive and active devices and circuit blocks are equally applicable to the corresponding devices of the present embodiment unless otherwise stated. The main difference between the present microphone assembly 300 and the previously described embodiments of the microphone assembly 100, 200 is that the each of the constant bias current sources M3 and M2 also functions as a switch and hence integrates the previously described functionality of the separate switch arrangements SW1. The control or gate terminal 313*b* of the constant bias current source M3 is controlled by a first control signal 311*b* supplied by either an optional release and attack time circuit 309 as indicated on the drawing or directly from the level detector 307. The control or gate terminal 313*b* is also connected to a suitable DC bias voltage $V_{BIAS}$ to set the desired DC bias current to M1 when the constant bias current source M3 is active as discussed in connection with M3 of FIG. 1. The first control signal 311*b* may be supplied by a tri-state output driver or port such that the first control signal 311*b* is set in a high-impedance state when the constant bias current source M3 is active. When the constant bias current source M3 on the other hand is turned off, the tri-state output driver may pull the control or gate terminal 313*b* to a fixed logic level or state with low impedance. Thereby, forcing the control or gate terminal 313*b* to a suitable electrical potential to switch the PMOS transistor M3 to its off-state or non-conducting state. The constant bias current sources M2 may be controlled in corresponding manner by controlling the voltage on the control or gate terminal 313*a* by a second control signal 311*a* from the release and attack time circuit 309 or directly from the level detector 307.

Items:

1. A hearing instrument comprising:

a microphone comprising a microphone transducer element mounted in a microphone housing wherein the microphone transducer element produces a transducer signal in response to receipt of sound, a microphone amplification circuit configured to generate an amplified microphone signal from the transducer signal, a control and processing circuit coupled to the microphone amplification circuit for receipt and processing of the amplified microphone signal according to a hearing loss of a user;

the microphone amplification circuit having a power supply port coupled to a switchable power supply, the switchable power supply is configured to selectively connect a first power supply voltage, having a first DC voltage level, or a second power supply voltage, having a second DC voltage level, to the power supply port of the microphone amplification circuit; where the second DC voltage level is higher than the first DC voltage level, a level detector configured to detect a level of a microphone signal and connect the first or the second power supply voltage to the power supply port based on the detected level of the microphone signal.

2. A hearing instrument according to item 1, wherein the microphone amplification circuit comprises:

a first preamplifier coupled directly to the transducer signal of the microphone transducer element and supplied with power from the first power supply voltage, or a third power supply voltage with a third DC voltage level lower than the second DC voltage level, a second preamplifier comprising a signal input port coupled to a signal output port of the first preamplifier and a power supply port coupled to the switchable power supply.

3. A hearing instrument according to item 2, wherein the microphone transducer element and the first preamplifier are arranged in a common microphone housing of the microphone; the microphone housing comprising a power supply terminal coupled to the first or third power supply voltage; and the second preamplifier, the first and second power supplies and the level detector being integrated on the control and processing circuit of the hearing instrument.

4. A hearing instrument according to item 2, wherein the microphone amplification circuit and the microphone transducer element are arranged inside the microphone housing.

5. A hearing instrument according to anyone of the preceding items, wherein the level detector is configured for connecting the first power supply voltage to the power supply port of the microphone amplification circuit if the detected level is below a predetermined threshold level and for connecting the second power supply voltage to the power supply port if the detected level is equal to or above the predetermined threshold level.

6. A hearing instrument according to any of the preceding items, wherein the switchable power supply comprises a controllable switch arrangement responsive to a switch control signal generated by the level detector, wherein the controllable switch arrangement is coupled to the first power supply voltage and to the second power supply voltage via first and second switch inputs, respectively, and a switch output is connected to the power supply port of the microphone amplification circuit.

7. A hearing instrument according to item 6, wherein the microphone amplification circuit further comprises:

an analog-to-digital converter configured for generating a digitized microphone signal based on the amplified microphone signal; and the level detector comprises a digital level detector configured for computing a level of the digitized microphone signal and supplying a digital switch control signal to the controllable switch arrangement.

8. A microphone assembly for a hearing instrument, comprising:

a microphone comprising a microphone transducer element mounted in a microphone housing wherein the microphone transducer element produces a transducer signal in response to receipt of sound, a microphone amplification circuit configured to generate an amplified microphone signal from the transducer signal, the microphone amplification circuit having a signal input port coupled to the transducer signal and a power supply port coupled to a switchable power supply, the switchable power supply configured to selectively connect a first power supply voltage, having a first DC voltage level, or a second power supply voltage, having a second DC voltage level, to the power supply input of the microphone amplification circuit; where the second DC voltage level is higher than the first DC voltage level, a level detector configured to detect a level of a microphone signal and connect the first or the second power supply voltage to the power supply port of the microphone amplification circuit based on the detected level of the microphone signal.

9. A microphone assembly according to item 8, wherein the switchable power supply comprises a controllable switch arrangement responsive to a switch control signal generated by the level detector, wherein the controllable switch arrangement is connected to the first power supply voltage and to the second power supply voltage via first and second switch inputs, respectively, and a switch output is connected to the power supply port of the microphone amplification circuit.

10. A microphone assembly according to item 8 or 9, wherein the microphone amplification circuit comprises:

a first preamplifier coupled directly to the transducer signal of the microphone transducer element and supplied with power from the first power supply voltage, or a third power supply voltage with a third DC voltage level lower than the second DC voltage level, a second preamplifier comprising a signal input port coupled to a signal output port of the first preamplifier and a power supply port coupled to the switchable power supply.

11. A microphone assembly according to item 10, comprising:

a bias current source coupled between an input transistor of the microphone amplification circuit and the output of the controllable switch arrangement.

12. A microphone assembly according to item 11, wherein the bias current source is configured to provide a substantially constant bias current independent of the level of the amplified microphone signal.

13. A microphone assembly according to any of items 9-12, comprising:

a first bias current source coupled between the first power supply voltage and the first input of the controllable switch arrangement, a second bias current source coupled between the second power supply voltage and the second input of the controllable switch arrangement.

14. A microphone assembly according to item 13, wherein the first and second bias current sources are configured to provide substantially equal bias current thereby providing a substantially constant bias current to the microphone amplification circuit independent of a state of the controllable switch arrangement.

15. A microphone assembly according to any of items 8-14, comprising a time constant circuit coupled to the level detector and configured to set an attack time and a release time of the switch control signal wherein:

at the attack of the switch control signal, the latter disconnects the power supply port of the microphone amplification circuit from the first power supply voltage and connects said power supply port to the second power supply voltage via the controllable switch arrangement.

16. A microphone assembly according to item 15, wherein the time constant circuit is configured to provide an attack time of less than 50 μs more preferably less than 10 μs.

17. A microphone assembly according to any of items 8-16, wherein the controllable switch arrangement comprises:

a first semiconductor switch connected between the first switch input and the switch output; and a second semiconductor switch connected between the second switch input and the switch output, each of the first and second semiconductor switches having a control terminal coupled to the switch control signal.

18. A microphone assembly according to item 17, wherein a first bias current source is integrated with the first semiconductor switch of the controllable switch arrangement; and a second bias current source is integrated with the second semiconductor switch of the controllable switch arrangement.

19. A microphone assembly according to any of items 8-18, comprising at least one of:

a DC-DC power converter, such as a boost converter or charge pump, configured to generate the second power supply voltage, a linear voltage regulator configured to generate the first power supply voltage and/or the third power supply voltage.

20. A hearing instrument comprising:

a microphone comprising a microphone transducer element mounted in a microphone housing, wherein the microphone transducer element is configured to provide a transducer signal in response to receipt of sound;

a microphone amplification circuit configured to generate an amplified microphone signal based on the transducer signal;

a control and processing circuit coupled to the microphone amplification circuit for receipt and processing of the amplified microphone signal according to a hearing loss of a user; and a level detector configured to detect a level of the amplified microphone signal;

wherein the microphone amplification circuit is coupled to a switchable power supply, and wherein the switchable power supply is configured to selectively connect a first power supply voltage, having a first DC voltage level, or a second power supply voltage, having a second DC voltage level, to the microphone amplification circuit based on the detected level of the amplified microphone signal, the second DC voltage level being higher than the first DC voltage level.

21. The hearing instrument according to item 20, wherein the microphone amplification circuit comprises:

a first preamplifier coupled to the microphone transducer element and is configured to receive power from the first power supply voltage, or a third power supply voltage with a third DC voltage level lower than the second DC voltage level; and a second preamplifier comprising a signal input port coupled to a signal output port of the first preamplifier, and a power supply port coupled to the switchable power supply.

22. The hearing instrument according to item 21, wherein the microphone transducer element and the first preamplifier are arranged in the microphone housing of the microphone; the microphone housing comprising a power supply terminal coupled to the first or third power supply voltage; and wherein the second preamplifier, the first and second power supplies, and the level detector being integrated on the control and processing circuit of the hearing instrument.

23. The hearing instrument according to item 20, wherein the switchable power supply is configured for connecting the first power supply voltage to the microphone amplification circuit if the detected level is below a predetermined threshold level, and for connecting the second power supply voltage to the microphone amplification circuit if the detected level is equal to or above the predetermined threshold level.

24. The hearing instrument according to item 20, wherein the switchable power supply comprises a controllable switch arrangement responsive to a switch control signal generated by the level detector;

wherein the controllable switch arrangement is coupled to the first power supply voltage and to the second power supply voltage via first and second switch inputs, respectively; and wherein the switchable power supply is configured by the switch control signal to selectively connect the first power supply voltage or the second power supply voltage to the microphone amplification circuit.

25. The hearing instrument according to item 24, wherein the microphone amplification circuit further comprises an analog-to-digital converter configured for generating a digitized microphone signal based on the amplified microphone signal; and wherein the level detector comprises a digital level detector configured for computing a level of the digitized microphone signal and supplying the switch control signal to the controllable switch arrangement, the switch control signal being a digital switch control signal.

26. A microphone assembly for a hearing instrument, comprising:

a microphone comprising a microphone transducer element mounted in a microphone housing, wherein the microphone transducer element is configured to provide a transducer signal in response to receipt of sound;

a microphone amplification circuit configured to generate an amplified microphone signal based on the transducer signal; and a level detector configured to detect a level of the microphone signal;

wherein the microphone amplification circuit is coupled to a switchable power supply;

wherein the switchable power supply is configured to selectively connect a first power supply voltage, having a first DC voltage level, or a second power supply voltage, having a second DC voltage level, to the microphone amplification circuit based on the detected level of the microphone signal, the second DC voltage level being higher than the first DC voltage level.

27. The microphone assembly according to item 26, wherein the switchable power supply comprises a controllable switch arrangement responsive to a switch control signal generated by the level detector;

wherein the controllable switch arrangement is connected to the first power supply voltage and to the second power supply voltage via first and second switch inputs, respectively; and wherein the switchable power supply is configured by the switch control signal to selectively connect the first power supply voltage or the second power supply voltage to the microphone amplification circuit.

28. The microphone assembly according to item 26, wherein the microphone amplification circuit comprises:

a first preamplifier coupled to the microphone transducer element, and is configured to receive power from the first power supply voltage, or a third power supply voltage with a third DC voltage level lower than the second DC voltage level; and a second preamplifier comprising a signal input port coupled to a signal output port of the first preamplifier, and a power supply port coupled to the switchable power supply.

29. The microphone assembly according to item 27, further comprising a bias current source coupled between an input transistor of the microphone amplification circuit and an output of the controllable switch arrangement.

30. The microphone assembly according to item 29, wherein the bias current source is configured to provide a substantially constant bias current independent of the level of the microphone signal.

31. The microphone assembly according to item 27, further comprising:

a first bias current source coupled between the first power supply voltage and the first switch input of the controllable switch arrangement; and a second bias current source coupled between the second power supply voltage and the second switch input of the controllable switch arrangement.

32. The microphone assembly according to item 27, further comprising a time constant circuit coupled to the level detector and configured to set an attack time and a release time of the switch control signal;

wherein the switch control signal during the attack time disconnects the microphone amplification circuit from the first power supply voltage and connects the microphone amplification circuit to the second power supply voltage via the controllable switch arrangement.

33. The microphone assembly according to item 27, wherein the controllable switch arrangement comprises:

a first semiconductor switch connected between the first switch input and a switch output; and a second semiconductor switch connected between the second switch input and the switch output;

each of the first and second semiconductor switches having a control terminal coupled to the level detector.

34. The microphone assembly according to item 33, wherein a first bias current source is integrated with the first semiconductor switch of the controllable switch arrangement, and a second bias current source is integrated with the second semiconductor switch of the controllable switch arrangement.

Although particular embodiments have been shown and described, it will be understood that they are not intended to limit the claimed inventions, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing instrument comprising: a microphone comprising a microphone transducer element mounted in a microphone housing, wherein the microphone transducer element is configured to provide a transducer signal in response to receipt of sound; a microphone amplification circuit configured to generate an amplified microphone signal based on the transducer signal; a control and processing circuit coupled to the microphone amplification circuit for receipt and processing of the amplified microphone signal according to a hearing loss of a user; and a level detector configured to detect a level of the amplified microphone signal; wherein the microphone amplification circuit is coupled to a switchable power supply, and wherein the switchable power supply is configured to selectively connect a first power supply voltage, having a first DC voltage level, or a second power supply voltage, having a second DC voltage level, to the microphone amplification circuit based on the detected level of the amplified microphone signal, the second DC voltage level being higher than the first DC voltage level; and wherein the switchable power supply comprises a first bias current source and a second bias current source, and wherein each of the first and second bias current sources functions as a switch, and wherein each of the first and second bias current sources comprises a gate terminal, and is controllable based on a control signal from the level detector or from another circuit component.

2. The hearing instrument according to claim 1, wherein the microphone amplification circuit comprises a first preamplifier and a second preamplifier, and wherein the first preamplifier is configured to receive power from the first power supply voltage, or a third power supply voltage with a third DC voltage level lower than the second DC voltage level; and wherein the second preamplifier comprises a signal input port coupled to a signal output port of the first preamplifier, and a power supply port coupled to the switchable power supply.

3. The hearing instrument according to claim 2, wherein the microphone transducer element and the first preamplifier are arranged in the microphone housing of the microphone; the microphone housing comprising a power supply terminal coupled to the first or third power supply voltage; and wherein the second preamplifier, the first and second power supplies, and the level detector being integrated on the control and processing circuit of the hearing instrument.

4. The hearing instrument according to claim 1, wherein the switchable power supply is configured for connecting the first power supply voltage to the microphone amplification circuit if the detected level is below a predetermined threshold level, and for connecting the second power supply voltage to the microphone amplification circuit if the detected level is equal to or above the predetermined threshold level.

5. The hearing instrument according to claim 1, wherein the switchable power supply comprises a controllable switch arrangement responsive to a switch control signal generated by the level detector;

wherein the controllable switch arrangement is coupled to the first power supply voltage and to the second power supply voltage via first and second switch inputs, respectively; and wherein the switchable power supply is operable by the switch control signal to connect the first power supply voltage or the second power supply voltage to the microphone amplification circuit.

6. The hearing instrument according to claim 5, wherein the microphone amplification circuit further comprises an analog-to-digital converter configured for generating a digitized microphone signal based on the amplified microphone signal; and wherein the level detector comprises a digital level detector configured for computing a level of the digitized microphone signal and supplying the switch control signal to the controllable switch arrangement, the switch control signal being a digital switch control signal.

7. The hearing instrument according to claim 1, wherein the microphone amplification circuit comprises a first preamplifier and a second preamplifier, and wherein the second preamplifier of the microphone amplification circuit is directly coupled to the first preamplifier of the microphone amplification circuit.

8. The hearing instrument according to claim 1, wherein the microphone amplification circuit comprises a first preamplifier coupled to the microphone transducer element, wherein the microphone amplification circuit also comprises a second preamplifier, and wherein the second preamplifier of the microphone amplification circuit is coupled to the first preamplifier of the microphone amplification circuit.

9. A microphone assembly for a hearing instrument, comprising: a microphone comprising a microphone transducer element mounted in a microphone housing, wherein the microphone transducer element is configured to provide a transducer signal in response to receipt of sound; a microphone amplification circuit configured to generate an amplified microphone signal based on the transducer signal; and a level detector configured to detect a level of the microphone signal; wherein the microphone amplification circuit is coupled to a switchable power supply; and wherein the switchable power supply is configured to selectively connect a first power supply voltage, having a first DC voltage level, or a second power supply voltage, having a second DC voltage level, to the microphone amplification circuit based on the detected level of the microphone signal, the second DC voltage level being higher than the first DC voltage level; and wherein the switchable power supply comprises a first bias current source and a second bias current source, and wherein each of the first and second bias; and wherein each of the first and second bias current sources comprises a gate terminal, and is controllable based on a control signal from the level detector or from another circuit component.

10. The microphone assembly according to claim 9, wherein the switchable power supply comprises a controllable switch arrangement responsive to a switch control signal generated by the level detector;

wherein the controllable switch arrangement is connected to the first power supply voltage and to the second power supply voltage via first and second switch inputs, respectively; and wherein the switchable power supply is operable by the switch control signal to connect the first power supply voltage or the second power supply voltage to the microphone amplification circuit.

11. The microphone assembly according to claim 9, wherein the microphone amplification circuit comprises a first preamplifier and a second preamplifier, and wherein the first preamplifier is configured to receive power from the first power supply voltage, or a third power supply voltage with a third DC voltage level lower than the second DC voltage level; and wherein the second preamplifier comprises a signal input port coupled to a signal output port of the first preamplifier, and a power supply port coupled to the switchable power supply.

12. The microphone assembly according to claim 9, further comprising an additional bias current source coupled to an input transistor of the microphone amplification circuit.

13. The microphone assembly according to claim 12, wherein the additional bias current source is configured to provide a substantially constant bias current independent of the level of the microphone signal.

14. The microphone assembly according to claim 9, wherein the first bias current source is coupled between the first power supply voltage and a first switch input; and wherein the second bias current source is coupled between the second power supply voltage and a second switch input.

15. The microphone assembly according to claim 9, further comprising a time constant circuit coupled to the level detector and configured to set an attack time and a release time of a switch control signal;

wherein the switch control signal during the attack time disconnects the microphone amplification circuit from the first power supply voltage and connects the microphone amplification circuit to the second power supply voltage.

16. The microphone assembly according to claim 9, wherein the first bias current source is a part of a first semiconductor switch connected between the a switch input and a switch output;

wherein the second bias current source is a part of a second semiconductor switch connected between a second switch input and the switch output;

each of the first and second semiconductor switches having a control terminal coupled to the level detector or to another component.

17. The microphone assembly according to claim 9, wherein the microphone amplification circuit comprises a first preamplifier and a second preamplifier, and wherein the second preamplifier of the microphone amplification circuit is directly coupled to the first preamplifier of the microphone amplification circuit.

18. The microphone assembly according to claim 9, wherein the microphone amplification circuit comprises a first preamplifier coupled to the microphone transducer element, wherein the microphone amplification circuit also comprises a second preamplifier, and wherein the second preamplifier of the microphone amplification circuit is coupled to the first preamplifier of the microphone amplification circuit.

* * * * *